US007682295B2

(12) United States Patent
Hulls

(10) Patent No.: US 7,682,295 B2
(45) Date of Patent: Mar. 23, 2010

(54) MULTIPLE RESISTANCE CURVES USED TO VARY RESISTANCE IN EXERCISE APPARATUS

(76) Inventor: Christopher R. Hulls, 9 Lorraine Ave., Point Reyes, CA (US) 94956

( * ) Notice: Subject to any disclaimer, the term of this patent is extended or adjusted under 35 U.S.C. 154(b) by 456 days.

(21) Appl. No.: 11/623,948

(22) Filed: Jan. 17, 2007

(65) Prior Publication Data

US 2007/0179029 A1 Aug. 2, 2007

Related U.S. Application Data

(60) Provisional application No. 60/759,642, filed on Jan. 17, 2006.

(51) Int. Cl.
*A63B 21/062* (2006.01)
*A63B 21/00* (2006.01)

(52) U.S. Cl. ..... 482/100; 482/135

(58) Field of Classification Search ..... 482/93–101, 482/135–138

See application file for complete search history.

(56) References Cited

U.S. PATENT DOCUMENTS

| | | | | |
|---|---|---|---|---|
| 5,967,954 | A * | 10/1999 | Habing | 482/137 |
| 6,685,600 | B1 * | 2/2004 | Ullman | 482/103 |
| 6,932,749 | B2 * | 8/2005 | Barnes et al. | 482/142 |
| 7,070,548 | B2 * | 7/2006 | Thonn, Jr. | 482/142 |
| 7,083,554 | B1 * | 8/2006 | Lo Presti | 482/137 |
| 7,335,141 | B2 * | 2/2008 | Piane, Jr. | 482/99 |
| 2005/0124470 | A1 | 6/2005 | Schopf | |

* cited by examiner

*Primary Examiner*—Fenn C Mathew
(74) *Attorney, Agent, or Firm*—Steven A. Nielsen; www.NielsenPatents.com

(57) ABSTRACT

Changing resistance patterns in an exercise machine is accomplished by moving a cable pivot point within a channel. The channel may take the form of numerous shapes. Multiple shapes may comprise one continuous channel. The placement of the pivot point and surrounding channel shape dictate the resistance pattern along the range of exercise motion. The pivot point is attached to two cables, one leading to a weight, the other leading to the user of the exercise machine.

2 Claims, 1 Drawing Sheet

MULTIPLE RESISTANCE CURVES USED TO VARY RESISTANCE IN EXERCISE APPARATUS

CROSS-REFERENCE TO RELATED APPLICATIONS

This application claims the benefit of U.S. provisional application 60/759,642 filed on Jan. 17, 2006 and titled "Dynamically variable resistance exercise apparatus" which is incorporated herein by reference.

STATEMENT REGARDING FEDERALLY SPONSORED RESEARCH OR DEVELOPMENT

Not Applicable

REFERENCE TO A SEQUENCE LISTING

Not Applicable

BACKGROUND OF THE INVENTION (1) Field of the Invention

The invention relates to means and methods of creating and using exercise machines that provide dynamic and variable resistance throughout the range of an exercise motion. A machine may be fitted with a plurality of different shaped curved members or channels that vary resistance along a range of motion.

(2) Description of the Related Art

Many exercise machines are known in the related art and attempt to provide either uniform or changing resistance along a range of motion. For example, in a traditional pulley system, uniform force is necessary to move a stack of weights. In a rotary cam system, a cam is used to vary resistance along a range of motion. The commercial products on the market offer one or the other. There are currently no commercially viable means of producing an exercise machine that offers different resistance patterns.

It is well known that explosive repetitions help athletes improve speed and strength much faster than slow movement over a range of motion. On a traditional machine, when a user attempts an explosive repetition, the resistance experienced at the middle of the motion is significantly lower than at the beginning of the motion due to the momentum of the weight stack. For those new to exercise equipment, there is a tendency to use poor form or to throw the entire body into an exercise movement. The related are does not provide a selectable resistance pattern to offset the momentum problem.

The related art has a similar shortcoming in accommodating a user who wishes to target a particular section of a range of motion. For example, a user may want to increase the resistance at the beginning of the range of motion. A subsequent user of the machine may wish to increase the resistance at the end of the motion.

The related art has made a few attempts to deliver a method of changing resistance patterns within an exercise machine, but all are prohibitively expensive or too cumbersome to achieve commercial success.

Early approaches to the problem included devices that directly resisted the torque input of the user and devices that had the weight cable rotate around a cam. Both of these methods, however, prove insufficient due to the limited variability of the resistance. Furthermore, the ability to increase and then decrease the resistance experienced along the range of motion was also limited.

Later inventions included devices with two cams on a single shaft, but with each cam connected to an individual weight stack. The user would then vary the relative resistance along the range of motion by selecting the desired combination of weights on the stack. Again, the amount and range of variability was limited.

U.S. patent application Ser. No. 2005/0124470 proposes means to vary the resistance along the range of motion by using a cam follower which traverses a cam of a specified shape, which itself is attached to a weight bearing trolley. The resistance experienced by the user is dependent on the shape of the cam. The cam follower is attached to a lever that is actuated by the users exercise motion. A movable member pushes up against the cam, thereby raising the trolley as the user conducts the exercise. To vary the resistance pattern, the user is required to change the variable shaped cam by removing it from the machine and replacing it with a new one, or by utilizing a rotating drum with multiple cam shapes that can be rotated so the desired shape is in contact with the cam follower.

Although an improvement on previous inventions, there are many shortcomings to this approach:

a) Without changing the shaped cam, the user is limited to a single pattern of resistance.

b) Changing of the cam is a time consuming and potentially dangerous process. Even with the multiple cams on a drum design, the load must be taken off of the cam roller, and a user's fingers could easily be caught between the two parts.

c) There are more moving parts than necessary to require the desired effect.

d) The design still relies on the traditional shaped cam method to vary the resistance pattern.

e) The result is unaesthetic.

f) The proper use of the disclosed system is counterintuitive.

Another approach in the related art to control variable resistance utilizes a computer controlled system that is either pneumatic, hydraulic or pulley based. Utilizing a computer controller, the desired effect is achieved quite well, but the costs are prohibitive, and the interface is overly complex for a casual user.

Thus, there is a need in the art for economical and practical means of changing resistance patterns within an exercise machine.

BRIEF SUMMARY OF THE INVENTION

The present invention overcomes shortfalls in the related art by providing multiple tracks of travel for an exercise pulley. A weight lifting exercise apparatus comprises a weight stack which is attached to a pulley system which leads to a pivot point after which the pulley is attached to a rolling mechanism contained within a track, slot or channel. The rolling mechanism is attached to another pulley system which is actuated by a user applying a force to a bar, lever, or other actuating mechanism.

By applying a force to the actuation mechanism, the roller slides along the track in the direction which causes the roller to move towards the first pulley in the actuation system. As the roller moves along the track, the weight stack moves upwards by an amount equal to the increase in radial distance of the rolling mechanism from the pivot point.

The track is molded in a shape that serves two purposes. The first purpose of the shape is to vary the relative resistance experienced by the user along the range of motion required to actuate the device. The resistance can be made to increase, decrease, remain linear, or increase and decrease along the range of motion. The resistance experienced by the user is dependent on the radial distance the roller mechanism moves away from the pivot point per unit of travel of the actuating mechanism. If the track is shaped to cause the roller to move along a radius of the pivot point, the force required to actuate the device is only the weight of the rolling mechanism, whereas if the track causes the roller to move in a direction perpendicular to the tangent line of the radius at the roller's starting location, the force required to actuate the device is equal to the weight stack plus the weight of the roller. Additionally, when the roller is at a position in the track that is pointed directly towards the pulley, no extra force is required to move the actuating mechanism. As the angle of the track moves relative to the pulley, the load can increase or decrease due to the change in the lever arm. This force reaches infinity (limited only by the durability of the apparatus itself) at the point where the angle of the track in relation to the cable leading to the first pulley of the actuating mechanism is 90 degrees.

The second consideration of the track shape is to allow the roller to have multiple neutral start positions where the force exerted by the weight of the actuation mechanism causes the pulley lines to be taut but not so much as to overcome the weight of the un-laden weight stack. Thus, the user can move the roller by sliding it along the track to the desired neutral location. The neutral locations are the starting positions for a new resistance pattern of the track. The number of positions can vary according to the desired size and design of the machine.

The weight of the actuating side of the mechanism must be greater than the weight of the pulley but less than the weight of the un-laden weight stack to ensure the roller will always return to a starting position when left standing.

OBJECTS AND ADVANTAGES

Accordingly, besides the objects and advantages inherent in all previous dynamic variable exercise machines, several objects and advantages of the present invention are:

a) to provide a dynamically variable resistance exercise machine with resistance levels from zero to infinity, b) to provide dynamically variable resistance without the use of cams, c) to provide dynamically variable resistance without the use of elastic bands, pneumatic devices, or computer controllers, d) to provide multiple resistance curves within a single apparatus and without the need to significantly reconfigure the machine, e) to provide multiple resistance curves within one track that can increase and then decrease, or decrease and then increase resistance multiple times through one range of motion, f) to provide said benefits with minimal moving parts, g) to provide users with a visual reference as to the relative resistance they will be experiencing (i.e. the user can easily watch the roller move up and down the track, and visualize the difference in resistance); and h) to provide said benefits while presenting a unique, attractive, futuristic and eye catching design.

These and other objects and advantages will be made apparent when considering the following detailed specification when taken in conjunction with the drawings.

DETAILED DESCRIPTION OF THE INVENTION

Exercise movements and weight selection are similar to other traditional exercise machines. For purposes of illustration, a pull-down machine is illustrated, but the principles of the invention are equally applicable to seated sit-up machines, standing curl machines, seated curl machines, leg press machines, pushdown bars and all other weight resistance apparatuses. However, unlike the related art, the user is allowed to conveniently select a resistance curve or resistance track.

To select the appropriate resistance curve, the user slides the roller along the track via a handle to the starting location of the desired curve. The resistance encountered to select a different starting location is minimal, as the track is designed so that the roller moves towards the pivot point when selecting a curve, thereby the only the weight of the actuating device must be overcome. This allows the resistance curve or resistance track to be changed without removing or changing the weight portion of the apparatus.

Figure 1:
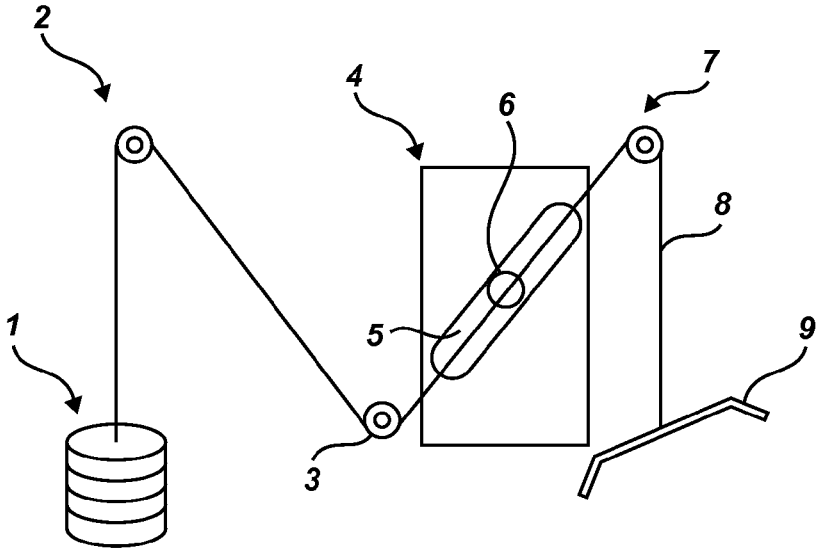
FIG. 1 is an elevation view of a pulley track providing uniform resistance along a range of motion.

FIG. 1 illustrates a track 5 of constant resistance along the range of exercise motion as the roller 6 is pulled in a direct path between the two closest pulleys 3 and 7. The roller also moves a distance along the track equal exactly to the length of cable pulled. The number of weight plates 1 may be selected by a user before or after a resistance track or curve is selected. In this illustration a pull-down bar 9 is connected via cable 8.

Figure 2:
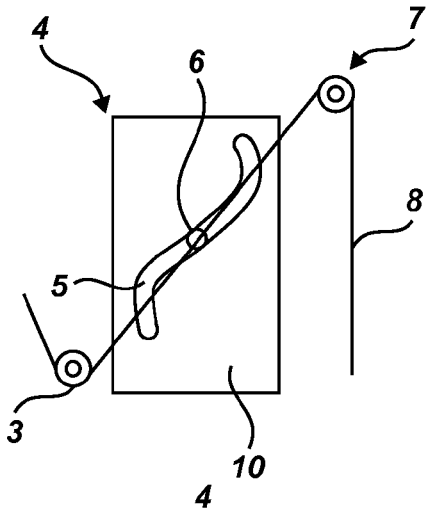
FIG. 2 is an elevation view of a pulley track providing varying resistance along a range of motion.

FIG. 2 illustrates a track 10 of varying resistance. As the angle of the pull on the roller shifts, and the lever arm changes, the user will experience different levels of resistance along the range of motion.

Figure 3:
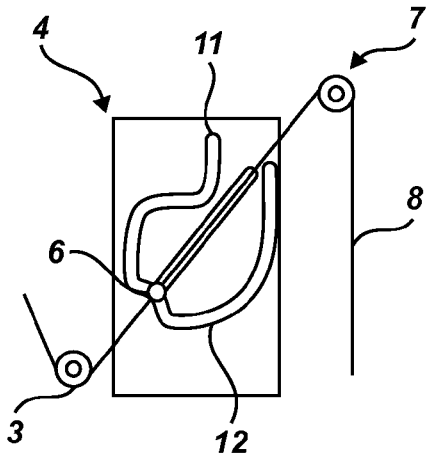
FIG. 3 is an elevation view of a multiple track system with different resistance patterns.

FIG. 3 shows a multiple track system 11 with different resistance patterns. To adjust tracks, the user slides the roller 6 down the guide slot and then upwards into the desired track. The roller can be moved via a handle or any other simple device. The roller will then stay in the proper track, as the weight of the input apparatus is greater than the weight of the roller, but less than that of the weight stack (there are other embodiments of the design where this would not be necessary). The track 11 need not be shaped in a forked pattern to have multiple tracks. The track could be designed so that the roller is moved up the track rather than down, and all the paths could be continuous. Increasing the size of the guide plate and making modifications to the pivot point could allow for paths moving in all directions.

To operate the embodiment of the apparatus illustrated in FIG. 3, the user selects the desired weight level 1. This can be accomplished via any of the traditional weight lifting machine designs. The user then applies a force to a pull down bar 9 or other input apparatus, which transfers the force along a cable 8, which is routed around a pulley 7. The cable is then attached to a roller mechanism 6, which slides along a slot 12 of the multiple track 11 which is cut into a guide plate 4. A track or other guide containment mechanism can be used, and a slot cut into a guide plate is only one method of attaining the desired result. The roller mechanism is then attached to another cable which leads to a pulley 3, which then leads to the weight portion of the mechanism. As the user applies a force to the input device, the cable pulls the roller which in turn pulls the weight stack upwards. The resistance experienced by the user is dependent on the shape of the track 11 and the amount of weight selected.

The figures herein represent only one embodiment of the design. Various incarnations of the machine are contemplated as being within the spirit of the invention and may be created by making modifications to the design, such as changing the shape of the track, moving the pivot point, or adding various pulleys or actuating mechanisms.

What is claimed is:

1. An exercise machine that provides means of changing multiple non uniform resistance patterns by use of a cable attached to a pulley and the pulley being confined within a system of multiple and non uniformed shaped slots, the exercise machine comprising:

a) a flexible member with a first end attached to a weight and with a second end attached to an exercise handle;

b) in an area between the weight and exercise handle, the flexible member is attached to a roller mechanism;

c) the roller mechanism is confined to a slot system, with the slot system comprising multiple tracks with each track having a non uniform path of travel and with each non uniform path of travel providing variable resistance while the exercise handle is pulled;

e) the roller mechanism being moveable within the slot system;

f) the roller mechanism being secured to a point within the slot system;

g) the non uniform paths of travel being secured within a guide plate; and h) the flexible member being secured into two fixed pulleys, with each fixed pulley positioned on either side of the guide plate.

2. A method of providing multiple resistance patterns and multiple tracks for roller mechanism attachment within a pulley exercise machine, the method comprising:

a) attaching a first end of a flexible member to a weight;

b) attaching a second end of the flexible to an exercise handle;

c) attaching a midsection of the flexible member to a roller mechanism, with the roller mechanism moving within two or more slots, with each slot comprising a non uniform path of travel and wherein each non uniform path of travel causes a non uniform pattern of resistance during movement of the flexible member;

c) attaching the flexible member to two fixed pulleys, with each pulley being located on either side of the multiple tracks; and d) using a guide plate to contain the slots.

* * * * *